United States Patent [19]

Gallmann

[11] 4,382,988

[45] May 10, 1983

[54] PROCESS FOR PREPARING A BITUMINOUS GROUND COVERING

[75] Inventor: Ernst Gallmann, Wettswil, Switzerland

[73] Assignee: Kibag Aktiengesellschaft Baggerei-Unternehmungen & Kieswerke am Zürichsee, Zürich, Switzerland

[21] Appl. No.: 199,728

[22] PCT Filed: Nov. 21, 1979

[86] PCT No.: PCT/CH79/00146

§ 371 Date: Aug. 6, 1980

§ 102(e) Date: Jul. 21, 1980

[87] PCT Pub. No.: WO80/01179

PCT Pub. Date: Jun. 12, 1980

[30] Foreign Application Priority Data

Dec. 6, 1978 [CH] Switzerland ..... 12449/78

[51] Int. Cl.[3] ..... D03D 13/00

[52] U.S. Cl. ..... 428/222; 106/281 R; 427/138; 427/139; 427/359; 428/291; 428/489

[58] Field of Search ..... 427/138, 186, 206, 139, 427/355, 359, 360, 369, 443; 404/70, 75; 52/309.1, 309.13, 309.15; 106/281 R; 428/285, 222, 291, 489

[56] References Cited

U.S. PATENT DOCUMENTS

| | | | |
|---|---|---|---|
| 2,355,430 | 8/1944 | Flood | 427/138 |
| 3,291,011 | 12/1966 | Defregger et al. | 427/139 |
| 3,429,094 | 2/1969 | Romunldi | 428/297 |
| 3,650,785 | 3/1972 | Ball et al. | 106/282 |
| 4,065,591 | 12/1977 | Gannon | 428/489 |

FOREIGN PATENT DOCUMENTS

| | | | |
|---|---|---|---|
| 472981 | 8/1914 | France . | |
| 2028683 | 10/1970 | France . | |
| 52-19566 | 5/1977 | Japan | 428/489 |
| 7100828 | 7/1971 | Netherlands | 106/281 |

*Primary Examiner*—Sadie L. Childs

*Attorney, Agent, or Firm*—Werner W. Kleeman

[57] ABSTRACT

A process for producing bituminous surfacing, bituminous surfacing produced by the process and hot plant mix for carrying out the process. To improve the resistance to fracture, the proposed bituminous surfacing contains metal fibers, for example steel fibers of finite length. These fibers can be admixed to the mix of solids mix and bituminous binder in the course of the preparation of the hot plant mix or in the course of laying the hot plant mix. Due to the compaction of the hot plant mix to form the bituminous surfacing, the metal fibres are bent and thus loop around the particles of the solids mix and/or form a network with one another to give a kind of random nonwoven fabric.

16 Claims, 4 Drawing Figures

PROCESS FOR PREPARING A BITUMINOUS GROUND COVERING

BACKGROUND OF THE INVENTION

The present invention relates to a process for producing bituminous surfacing, wherein a solids mix is mixed with a bituminous binder in the flowable state, the mix formed is applied to the foundation, which is to be provided with the bituminous surfacing, and is then compacted. The invention also relates to bituminous surfacing produced by this process and to a hot plant mix for carrying out the process.

When producing bituminous surfacing, as is known, a solids mix is mixed with a bituminous binder. This mix is also called hot plant mix—as long as the binder is liquid in a manner of speaking. As a rule, the term "solids mix" is to be understood as a mixture of essentially different fractions of gravel and/or chippings and of screenings, whilst the term "bituminous binder" is to be understood as bitumen, tar or a mixture of these two.

As is known, such a binder has the property, at elevated temperature, of possessing a flowability which is comparable to that of a liquid and which decreases with falling temperature, but is never completely lost.

In producing bituminous surfacing, the hot plant mix mentioned above is supplied in situ or—as is more often the case—is delivered to the site in the hot state as a semi-finished product, as it were. On site, the hot plant mix is applied to the foundation (as a rule a gravel bed or a crushed stone bed) which is to be provided with bituminous surfacing, for example by means of a finishing machine, and is then compacted. Compacting is effected by exerting a pressure (for example by means of rollers) which forces the particles of the solids mix closer together and thus presses the bituminous binder into the interspaces which have remained free.

It is known that the surface of bituminous surfacing, which is subjected to loading again and again in one and the same area (for example along the tracks of vehicle wheels), is correspondingly deformed. This deformation is to be ascribed not only to wear but also to a plastic deformation of the surfacing, which deformation takes place only very slowly but sooner or later leads to fracture or crumbling of the bituminous surfacing, if the latter is not of sufficient depth.

SUMMARY OF THE INVENTION

The process according to the invention now makes it possible to obtain bituminous surfacing which is substantially tougher and/or more resistant to fracture.

The process is characterised in that metal fibres are admixed to the mix. Advantageously, these metal fibres are steel fibres of finite length. Accordingly, the resulting bituminous surfacing additionally contains metal fibres in the matrix which essentially contains the solids mix and the bituminous binder.

Admittedly, the use of metal fibres and also steel fibres of finite length for the reinforcement of concrete has already been disclosed, for example, in U.S. Pat. No. 3,429,094. In this case, however, the interaction between the cement (as the binder) and the steel fibres is fundamentally different. The adhesion of the cement to the individual fibre is comparable to a "microscopic positive connection" since, during the setting of the cement, the surface of the fibre is chemically attacked, that is to say roughened, and the still liquid cement slurry is attached to this roughened surface. After setting (which is an irreversible process) the cement has become a solid which adheres to the metal fibre for the reasons described above. During the compaction (by vibration) of the still flowable concrete mix, no pressure is exerted on the latter; merely, the air occlusions are expelled from the concrete mix in the manner of rising bubbles. The metal fibres present in the concrete mix thus undergo virtually no deformation; instead, they are merely wetted all round by the cement slurry and then remain anchored in the concrete in the random arrangement.

By contrast, the interaction of the metal fibres with the other components in the bituminous surfacing, proposed according to the invention, is different. On the one hand, the metal fibre in the bituminous binder is not exposed to any superficial chemical attack. Thus, when the bituminous binder solidifies on cooling, only a fractional connection results between the latter and the metal fibre, since the binder is only "glued" to the fibre. This is also the reason for the fact that metal reinforcement of bituminous surfacing has not been proposed by those skiled in the art in the past. Furthermore, in the case of the proposed bituminous surfacing, the original shape of the metal fibres is deformed during the compaction phase which—as already mentioned—is effected by the action of an external pressure, so that, as it were, they loop around the solids particles in the surfacing on the one hand and are mutually intertwined, so that a kind of random nonwoven fabric which—"cemented" by the bituminous binder—additionally holds the particles of the solids mix together, is present in the proposed bituminous surfacing in addition to the particles of the solids mix, which are firmly pressed together. When the proposed bituminous surfacing in use is subjected to loading, the said positive connection between the binder and the metal fibre is enhanced at the instant of this loading so that, as a result, a considerably increased resistance against fracture is produced, the more so since the metal fibres assist to a very considerable extent in distributing pressure loadings on locally narrowly limited points of the surfacing, over greater surface areas.

Pressure tests on specimens of the bituminous surfacing, proposed according to the invention, have shown that it is entirely possible to deform this bituminous surfacing by the conventional test methods, but it was not possible to induce a fracture, that is to say crumbling, of the specimen.

Since, as mentioned, the original shape of the metal fibres in the proposed bituminous surfacing is distorted during the compaction phase, and the fibres are thus pre-tensioned as it were, the proposed bituminous surfacing should also be expected to have a certain recovery capacity in the sense that, after deformations have occurred, the surfacing is partially resilient; of course, this process is also dependent on the temperature. Finally, due to the metal fibres, the proposed bituminous surfacing also has a considerably higher heat conductivity. The increased heat conductivity largely prevents accumulations of heat on the top of the surfacing, whilst, in the known surfacings, such accumulations of heat—for example due to strong insolation—lead to liquefaction of the binder on the surface.

BRIEF DESCRIPTION OF THE DRAWINGS

In the following text, an illustrative embodiment of the invention is described in more detail by reference to the drawing in which.

DETAILED DESCRIPTION OF THE PREFERRED EMBODIMENTS

Figure 1:
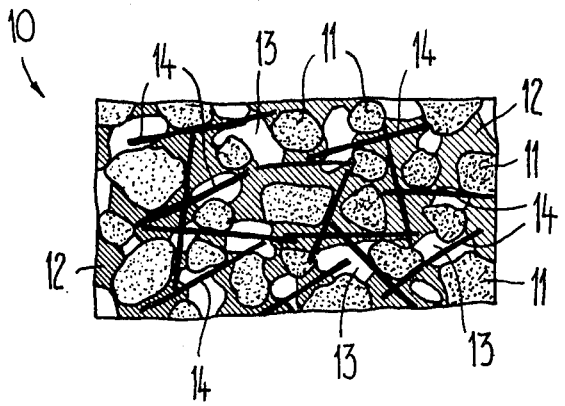
FIG. 1 shows the texture of a hot plant mix in which steel fibres of finite length are embedded.

In FIG. 1, the texture of a hot plant mix 10 can be seen diagrammatically. The particles of the solids mix are designated by reference character 11, the still more or less liquid bituminous binder (hatched obliquely) is designated by 12 and air occlusions, which are still present, are designated by 13. Substantially straight steel fibres 14 of finite length are embedded in a random arrangement in this mix.

The composition of the hot plant mix according to FIG. 1 can, for example, be one of the following (data in percent by weight):

| | I | II |
|---|---|---|
| Solids mix | | |
| 0–3 mm screenings (unwashed) | 28–30% | 39.23% |
| 3–6 mm chippings | 15–16% | 0.96% |
| 6–10 mm chippings | 44–47% | — |
| 10–16 mm chippings | — | 49.76% |
| Filler (dust) | 4–5% | 3.83% |
| Steel fibres: | 1.8–2.5% | 1.92% |
| Bitumen: (B 60–70) | 6.1–6.7% | 4.30% |

The composition according to Example II is particularly suitable for heavily loaded road surfacings.

It can be seen from FIG. 1 that, due to its ability to creep readily, the bituminous binder 12 wets the major part of the surface of the particles 11 and also creeps along the fibres 14. The steel fibres 14 can, for example, have a length of about 25 mm and a circular cross-section within the range of diameters of 0.3–0.5 mm or a rectangular cross-section of about 0.25×0.5 mm. Suitable steel fibres are manufactured, for example, by United States Steel Corporation and are marketed under the name "Fibercon."

Figure 2:
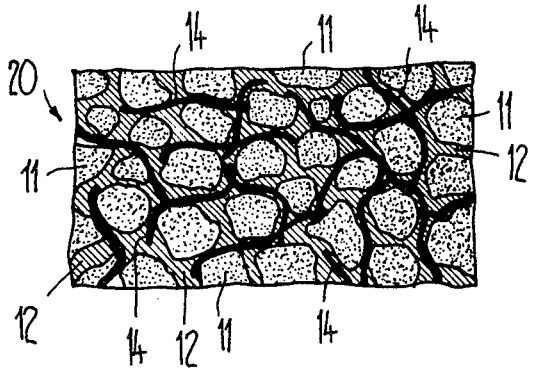
FIG. 2 shows the texture of surfacing, produced with the hot plant mix according to FIG. 1, after the compaction phase.

FIG. 2 shows the texture of a bituminous surfacing 20 formed by compaction of the hot plant mix according to FIG. 1. The compaction is effected—as already stated—by exerting a pressure on the hot plant mix from the outside, for example by means of rollers. This pressure effects, in a manner of speaking, a thorough milling of the texture according to FIG. 1, the major part of the air occlusions 13 being squeezed out. The particles 11 are thus forced more closely together and the bituminous binder 12 is pressed into the interspaces, still present, between the particles 11. During this step, the originally straight fibres 14 are bent and thus caused to loop around the particles 11 on the one hand and, on the other hand, to intertwine mutually in the manner of a random nonwoven fabric.

Figure 3:
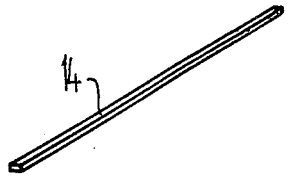
FIGS. 3 and 4 show examples of metal fibres, namely of steel fibres of finite length, such as can be used for preparing the hot plant mix according to FIG. 1.
Figure 4:
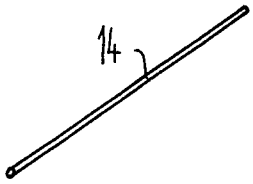

As mentioned, the fibres can have a circular cross-section, as shown in FIG. 4, or they can advantageously have a quadrangular, in particular rectangular, cross-section as shown in FIG. 3.

Advantageously, the length of the fibres is matched to the coarsest fraction of the solids mix. At present, it is assumed that a length greater than the mean particle diameter of the coarsest fraction would be the most advantageous, also from the point of view of the preparation of the hot plant mix.

The addition of the fibres can take place during the preparation of the hot plant mix in such a way that they are admixed to the solids mix during the process of mixing the latter or during the admixing of the (hot) bituminous binder. It is also possible to apply a hot plant mix, which is still fibre-free, in several thin layers on the foundation which is to be provided with the surfacing, and to scatter fibres on each layer of hot plant mix, whereupon the various layers are rolled conjointly.

While there are shown and described present preferred embodiments of the invention, it is to be distinctly understood that the invention is not limited thereto, but may be otherwise variously embodied and practiced within the scope of the following claims.

ACCORDINGLY

I claim:

1. A process for preparing a bituminous ground coating, said process comprising the steps of:

admixing a solid particle mixture including a predetermined coarsest fraction to a bituminous binder in a flowable state to form a mix;

admixing ether to said mix or to said solid particle mixture finite, generally straight metallic fibers having a length which corresponds at least to the mesh size of said coarsest fraction to obtain a fiber-containing mix;

applying said fiber-containing mix on the ground to be covered to form a cover layer; and applying external pressure to compact said cover layer and deforming said fibers about said solid particles within said mix whereby the fibers entangle with said particles and with each other to enhance bonding between fiber containing solids and said binder.

2. The process as defined in claim 1, wherein:

the amount of said fibers is between 0.1% and 4% by weight relative to the solid particle mixture.

3. The process as defined in claim 2, wherein:

said metallic fibers comprise steel fibers having a rectangular cross-section, the side length of said rectangular cross-section not exceeding 0.5 mm.

4. The process as defined in claim 1, wherein:

the metallic fibers are steel fibers.

5. The process as defined in claim 1, wherein:

the metallic fibers comprise steel fibers having a rectangular cross-section, the side length of said rectangular cross-section not exceeding 0.5 mm.

6. A process for preparing a bituminous ground coating, said process comprising the steps of:

admixing a solid particle mixture having a coarsest fraction to a bituminous binder in a flowable state to form a mix;

admixing to said mix a percentage between 0.1% and 4% by weight of finite straight metallic fibers having a length which corresponds at least to the mesh size of said coarsest fraction to obtain a fiber-containing mix; applying said fiber-containing mix on the ground to be covered to form a cover layer; and applying external pressure to compact said cover layer and deforming said fibers about said solid particles within said mix whereby the fibers entangle with said particles and with each other to enhance bonding between fiber containing solids and said binder.

7. The process as defined in claim 6, wherein:

said metallic fibers have a rectangular cross-section, the side length of said rectangular cross-section not exceeding 0.5 mm.

8. The process as defined in claim 6, wherein:

the metallic fibers are steel fibers.

9. A process for preparing a bituminous ground coating, said method comprising the steps of:

admixing a solid particle mixture having a predetermined coarsest fraction to a percentage between 0.1% and 4% by weight of finite straight metallic fibers having a length which corresponds at least to the mesh size of said coarsest fraction to obtain a fiber containing dry, solid particle mixture;

admixing said solid particle mixture to a bituminous binder in a flowable state to form a fiber-containing mix;

applying said fiber-containing mix on the ground to be covered to form a cover layer; and applying external pressure to compact said cover layer and deforming said fibers about said solid particles within said mix whereby the fibers entangle with said particles and with each other to enhance bonding between fiber containing solids and said binder.

10. The process as defined in claim 9, wherein:

the metallic fibers are steel fibers.

11. The process as defined in claim 10, wherein:

the metallic fibers are steel fibers having a rectangular cross-section, the side length of said rectangular cross-section not exceeding 0.5 mm.

12. A bituminous surfacing produced according to the process of claim 1.

13. A bituminous surfacing as defined in claim 12, wherein:

the metallic fibers are steel fibers of finite length.

14. The bituminous surfacing as defined in claim 13, wherein:

the mix contains a coarsest fraction; and the length of the steel fibers is greater than the size range of the coarsest fraction of the mix.

15. The bituminous surfacing as defined in claim 12, wherein:

the metal fibers are bent around particles of the mix.

16. The bituminous surfacing as defined in claim 12, wherein:

the metallic fibers are mutually intertwined in the formed mixture in the manner of a random nonwoven fabric.

* * * * *